United States Patent [19]

Konieczny et al.

[11] 4,244,626

[45] Jan. 13, 1981

[54] ROTARY CUTTER FOR GOUGING OUT ORE FROM MINE FACES OR THE LIKE

[75] Inventors: Klaus Konieczny; Erich Schmitt, both of Recklinghausen; Adolf Buhles, Neunkirchen, all of Fed. Rep. of Germany

[73] Assignees: Gesteins- und Tiefbau GmbH, Recklinghausen-Hochlarmark; H. Krummenauer KG, Neunkirchen, both of Fed. Rep. of Germany

[21] Appl. No.: 950,692

[22] Filed: Oct. 12, 1978

[30] Foreign Application Priority Data

Oct. 14, 1977 [DE] Fed. Rep. of Germany ..... 2746169

[51] Int. Cl.[3] ..... E21B 13/04

[52] U.S. Cl. ..... 299/90; 175/404

[58] Field of Search ..... 299/10, 18, 55, 56, 299/60, 85–90; 175/91, 377, 391, 404

[56] References Cited

U.S. PATENT DOCUMENTS

| | | | |
|---|---|---|---|
| 2,741,462 | 4/1956 | Baca | 299/87 X |
| 2,784,955 | 3/1957 | Compton | 299/87 |
| 3,074,703 | 1/1963 | Adams et al. | 299/90 |
| 3,388,949 | 6/1968 | Kozar | 175/404 X |
| 3,951,220 | 4/1976 | Phillips, Jr. et al. | 175/404 X |

*Primary Examiner*—James A. Leppink

*Attorney, Agent, or Firm*—Peter K. Kontler

[57] ABSTRACT

A rotary cutter for gouging out ore from mine faces has an annular front section with a set of bits which cut a ring-shaped groove into the mine face when the cutter is rotated and moved forwardly toward and into the mine face, and a rear section which is surrounded by the annular section and carries a second set of bits which comminute the core within the ring-shaped groove. The rear section has a conical bottom wall for the respective bits and a cylindrical wall surrounding and extending forwardly of the conical wall. The cylindrical wall has outlets for evacuation of comminuted material of the core. Such comminuted material is discharged into spaces between the cylindrical wall and sickle-shaped arcuate supports which carry additional bits and slope rearwardly and outwardly, as considered in the direction of rotation and forward movement of the cutter.

11 Claims, 4 Drawing Figures

ROTARY CUTTER FOR GOUGING OUT ORE FROM MINE FACES OR THE LIKE

BACKGROUND OF THE INVENTION

The present invention relates to improvements in rotary cutters for making holes in seams of ore, rock or the like, especially for gouging out ore in mine faces of underground excavations.

It is known to provide the rotary cutter of a mining machine with a front set of material removing bits which penetrate into a seam or body of rock or ore (hereinafter called ore for short) when the cutter is driven to rotate about is axis and is simultaneously moved forwardly toward and into the seam, e.g., into the face of a seam of coal at the front end of an underground excavation. Examples of mining machines which embody such cutters are so-called coal moles. Each cutter further carries a second set of bits which surround and are located rearwardly of the front bits to remove material from the seam when the cutter is moved sideways, i.e., radially of the hole which is formed by the front bits. As a rule, heretofore known cutters of the just outlined character resemble slender cones with rounded apices or truncated cones with slightly concave or convex front end faces (i.e., those end faces which are remote from the bases of the respective cones). The exterior of the cone carries the aformentioned front bits which remove material while the cutter penetrates into the seam. The bits of the second set are attached to the conical surface rearwardly of the apex of the cutter to remove material while the cutter moves sideways, e.g., up and down and horizontally back and forth, to thereby enlarge the hole which is formed by the front bits during initial penetration of the cutter into the seam. The (front) bits which are attached to and extend forwardly from the front end face also engage the material of the seam during lateral movement of the cutter. The axes of the front bits are nearly parallel to the axis of the cone, i.e., the angle between the axis of each such bit and the axis of the cone is a relatively small acute angle. The peripheral speed of such bits is relatively low and the torque which is applied thereto is substantial. This brings about a number of drawbacks. First of all, the stresses upon the front bits which are nearly parallel with and close to the axis of the conical cutter are very pronounced; therefore, these bits are subjected to extensive wear and are heated to elevated temperatures during removal of material. This causes their material (normally hard steel) to become brittle and to break after relatively short periods of use. The same holds true for the holders which connect the just discussed bits to the body of the conical cutter. It has been found that the useful life of holders for the front bits which are close to the axis of the cutter, i.e., for the bits which are located at the forward end of the conical body of the cutter, is extremely short. Consequently, the cutter must be dismantled and its front bits as well as their holders replaced at frequent intervals with attendant losses in output. The dismantling and overhauling of cutters must be carried out in a workshop.

Secondly, the front bits whose peripheral speed is low tend to jam in the material of the seam. Once a front bit jams, the cutter tends to rotate about the jammed front bit rather than about the axis of its conical body. This will be readily appreciated by hearing in mind that the axes of bits which are located at the forward end of the cutter are nearly parallel to the axis of the conical body. Since the cutter is normally mounted at the forward end of an elongated arm or boom, jamming of a front bit and the resulting rotation of the cutter about the jammed bit entails pronounced vibration and other undesirable stray movements of the entire boom as well as of other parts of the mining machine with well-known undesirable consequences including noise, excessive wear and tendency to break.

OBJECTS AND SUMMARY OF THE INVENTION

An object of the invention is to provide a novel and improved cutter for use in mining machines and to construct and assemble the cutter in such a way that the useful life of its bits and other parts in substantially longer than that of bits in heretofore known cutters.

Another object of the invention is to provide a cutter wherein certain bits which participate in removal of material during initial penetration of the cutter into a seam of ore or the like need not and preferably cannot participate in removal of material during sidewise movement of the cutter.

A further object of the invention is to provide a cutter wherein the bits are distributed in such a way that they do not exhibit the tendency to jam during sidewise movement of the cutter upon completion of the making of a hole in a mine face or the like.

An additional object of the invention is to provide a cutter which is constructed and assembled in such a way that the wear upon its bits and/or other component parts is more uniform than in heretofore known cutters.

Another object of the invention is to provide a cutter which generates less noise than conventional cutters and performs negligible (if any) stray movements during initial penetration into a seam of ore or the like and/or during subsequent enlargement of the initially formed hole.

An ancillary object of the invention is to provide the cutter with bits in a novel and improved distribution and orientation.

Another object of the invention is to provide the cutter with novel and improved means for evacuating comminuted material during initial penetration of the cutter into a mine face or the like.

The invention is embodied in a rotary cutter for gouging out ore from seam, particularly from mine faces in underground excavations. The cutter comprises an annular section, a second section which is surrounded by and is located rearwardly of the annular section (as considered in the direction of penetration of the cutter into a seam of coal, rock or the like), a first set of material removing bits provided on the annular section to remove material from the face of a seam while the cutter moves forwardly (i.e., with the annular section located ahead of the second section, as considered in the axial direction of the annular section) whereby the non-removed material (namely, that material which is not removed by the first set of bits) forms a core which extends toward the second section and is surrounded by the annular groove cut by the first set of bits, and a second set of bits provided on the second section to comminute the material of successive increments of the core as the cutters move forwardly. Since the bits of the second set are located behind the bits of the first set, they do not participate in removal of material while the cutter moves sideways to enlarge the hole which is formed by the first and second sets of bits during initial penetration into the face of a mine or the like. Sidewise or lateral movement of the cutter results in removal of material by the first set of bits (i.e., by those bits which are remote from the axis of rotation of the cutter) and preferably by additional bits which are mounted on supports located externally of the second section and sloping outwardly and rearwardly as considered in the axial and circumferential directions of the annular section. The second section preferably includes a slightly conical bottom wall which carries the bits of the second set and a tubular (e.g., cylindrical) wall which surrounds the bottom wall and extends forwardly to the inner portion of the annular section. The tubular wall is formed with outlets in the form of circular or otherwise configurated openings which allow for evacuation of comminuted material of the core into the spaces between the outer side of the tubular wall and the supports for additional bits.

At least some bits of the second set are preferably remote from the axis of the cutter, i.e., such bits are preferably mounted on the conical bottom wall close to the inner surface of the tubular wall of the second section. This further reduces the likelihood of jamming of bits of the second set during initial penetration of the cutter into the face of a mine or the like.

The annular section preferably comprises a substantially washer-like base which is rigid with the front end portion of the tubular wall of the second section and a composite ring-shaped carrier for the first set of bits. The carrier may consist of several arcuate portions or components which are individually secured to the base, e.g., by screws, bolts and nuts or other suitable fastening means so as to enable an attendant to remove only one or a few components of the carrier when the respective bits are damaged or destroyed.

The novel features which are considered as characteristic of the invention are set forth in particular in the appended claims. The improved cutter itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
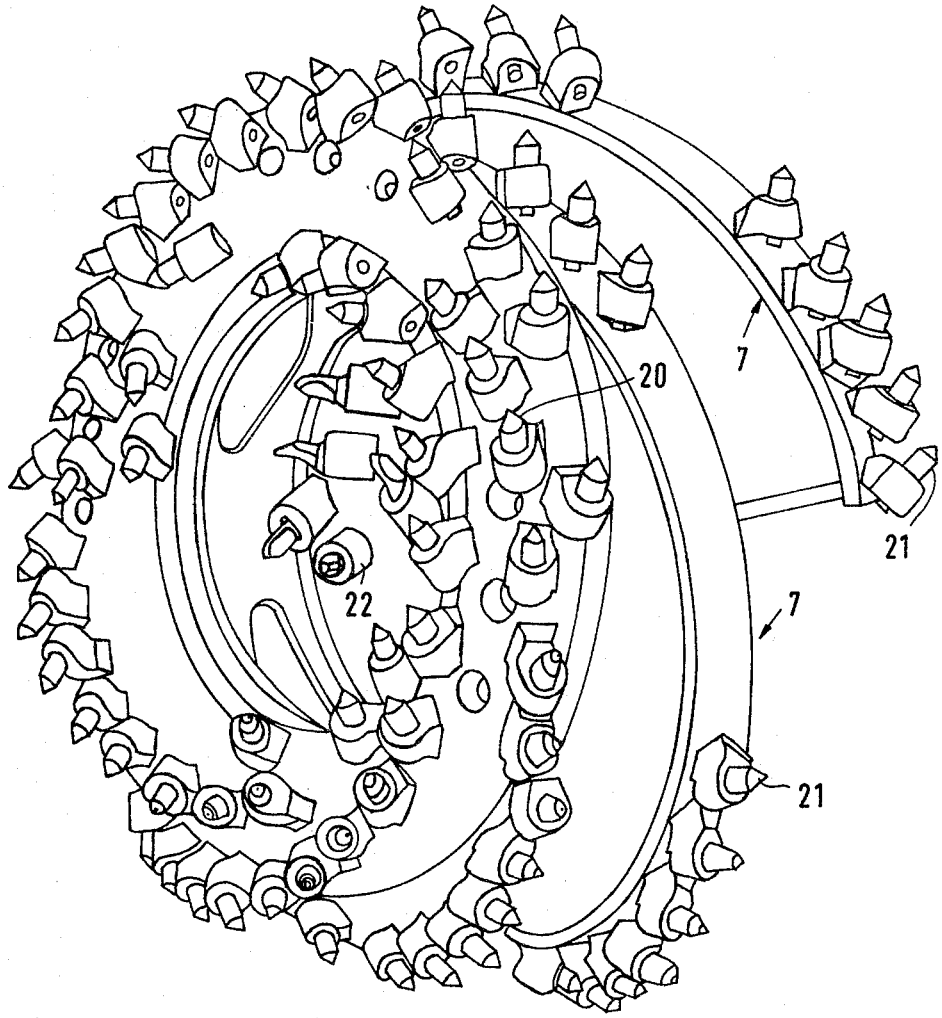
FIG. 1 is a perspective view of a portion of a cutter which embodies the invention, showing the distribution and orientation of bits which constitute the first and second sets as well as of additional bits which are mounted on the arcuate sickle-shaped supports around the second section.

The drawing shows a rotary cutter which comprises an annular section A, a second section B and a third section C including several arcuate substantially sickle-shaped supports 7 which slope rearwardly and outwardly, as considered in the direction of rotation of the cutter. The section A carries a first set of bits 20, the section B carries a second set of bits 22, and the supports 7 carry additional bits 21. The means for rotating the cutter comprises a substantially cylindrical casting 1 having at its rear end a flange 2 which is fastened (in a manner not shown in the drawing) to the torque transmitting means of the mining machine, e.g., to a shaft which is rotatable in a boom and can rotate the cutter in a counterclockwise direction, as viewed in FIG. 3, as well as move the cutter forwardly (namely, upwardly, as viewed in FIG. 2) so as to cause the bits 20 to penetrate into the mine face in an underground excavation.

Figure 2:
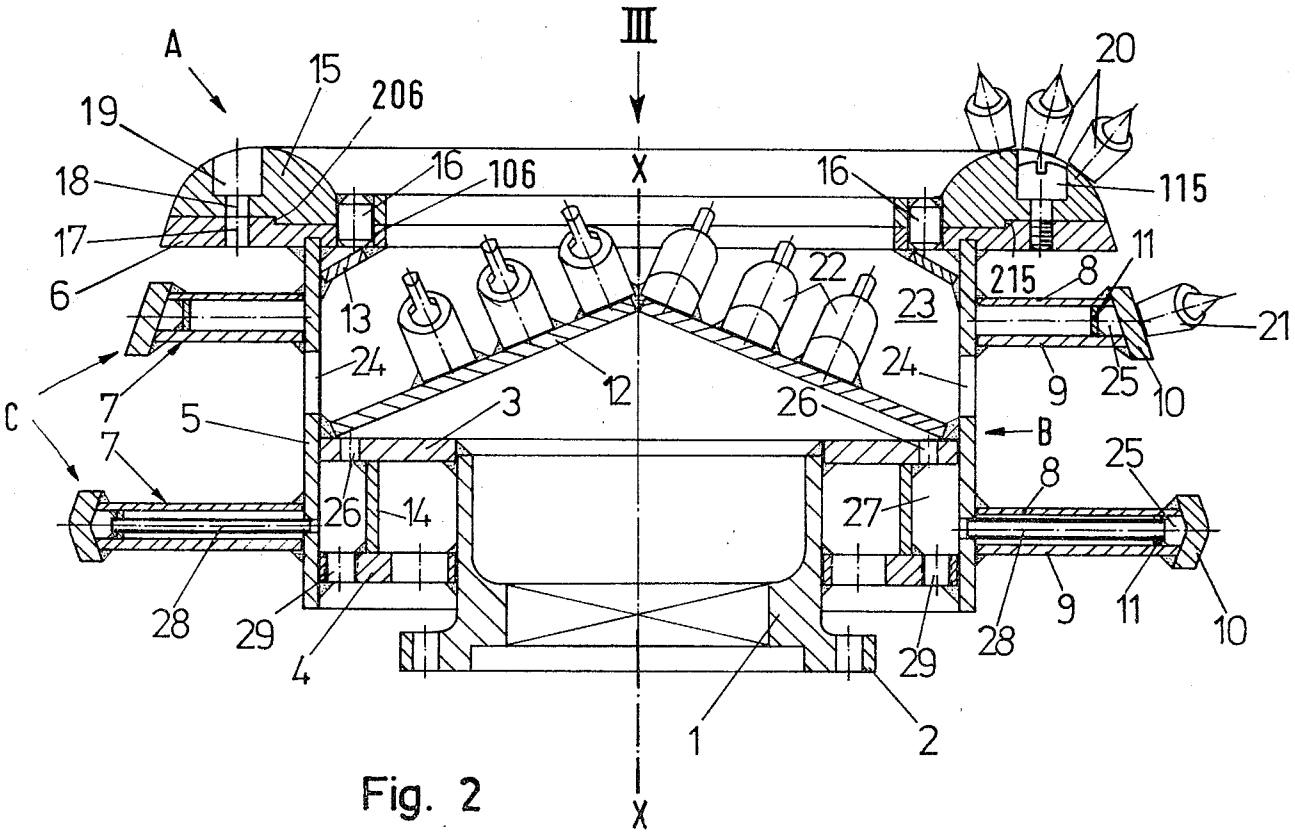
FIG. 2 is an axial sectional view of the cutter.

The casting 1 is surrounded by and welded to two coaxial ring-shaped members 3 and 4 which are surrounded by and welded to a tubular (preferably cylindrical) wall 5 of the section B. The front end portion of the tubular wall 5 is welded to a washer-like base 6 of the annular section A. The inner end portions of the supports 7 are welded to the external surface of the tubular wall 5, and each of these supports resembles a portion of a spiral. Each support 7 comprises two parallel side walls or flanges 8, 9 and a strong cover member or web 10 which supports the additional bits 21. A relatively thin partition 11 is installed between the side walls 8, 9 of each support 7 inwardly of and spaced apart from the respective web 10. FIG. 2 shows that the radially outermost side of the section A and the webs 10 are located at the periphery of an imaginary cone whose axis coincides with the axis X-X of the casting 1.

The section B further comprises a conical bottom wall 12 whose marginal portion is welded to the inner side of the tubular wall 5 and which carries the bits 22. The height of the conical wall 12, as considered in the axial direction of the casting 1 (i.e., in the axial direction of the annular section A) is only a small fraction of the inner diameter of the tubular wall 5. The apex of the conical wall 12 is located rearwardly of the base 6 of the section A. The radially innermost portion of the base 6 extends inwardly beyond the front end portion of the tubular wall 5 and the resulting annular space between the parts 5 and 6 is sealed off by a hollow frustoconical reinforcing ring 13 which is welded to the rear side of the inner portion of the base 6 as well as to the inner side of the front end portion of the tubular wall 5. A cylindrical partition 14 is installed in the space between the ring-shaped members 3, 4; this partition is coaxial with and is spaced apart from the casting 1 as well as from the rear end portion of the tubular wall 5. FIG. 2 shows that all of the heretofore described parts are welded to each other.

The section A further comprises a ring-shaped carrier 15 which is separably secured to the base 6 by screws 115 or analogous fastening means. The shanks of the screws 115 extend through registering holes 17, 18 of the base 6 and carrier 15, and the heads of the screws 115 are received in enlarged portions 19 of the respective holes 18. The holes 17 are tapped. The carrier 15 is provided with an annulus of centering pins 16 which are welded thereto and extend into complementary sockets or holes 106 of the base 6. Additional centering action is achieved by the provision of complementary annular shoulders 206, 215 at the front side of the base 6 and the rear side of the carrier 15.

The carrier 15 supports the holders for the bits 20 of the first set. The orientation of the bits 20 which form the first set is not uniform; this can be readily seen in FIGS. 2 and 3. Thus, some of the bits 20 are substantially parallel to the axis X-X, certain other bits 20 are inclined inwardly toward the extension of the axis X-X forwardly beyond the section A, and certain bits 20 are inclined forwardly and outwardly. When the cutter is in use, i.e., when the casting 1 is rotated by a prime mover and is moved forwardly (counter to the direction indicated by arrow III in FIG. 2), the bits 20 remove material from the mine face and form an annular hole or groove which surrounds a substantially cyindrical core whereby such core penetrates through and rearwardly beyond the annular section A and into the operating range of the bits 22 whose holders are secured to the conical front side or surface of the bottom wall 12 of the section B. At least some of the bits 22 are closely adjacent to the inner side of the tubular wall 5 (i.e., to the innermost portion of the section A) to reduce the likelihood of jamming when the cutter is in use. The additional bits 21 on the webs 10 of the sections 7 are inclined outwardly and serve to remove material from the mine face when the cutter is moved sideways, e.g., to the right or to the left, as viewed in FIG. 2, in order to enlarge the hole which is formed by the bits 20, 22 which gouge out coal, rock or other material from the mine face.

The axes of the bits 22 of the second set are preferably normal to the adjacent portions of the conical front surface of the bottom wall 12 of the second or central section B of the cutter. The material removing portions of the bits 22 extend forwardly, i.e., they can remove material from the rear end face of the aforediscussed core which develops on penetration of the bits 20 of the first set into the mine face.

Figure 4:
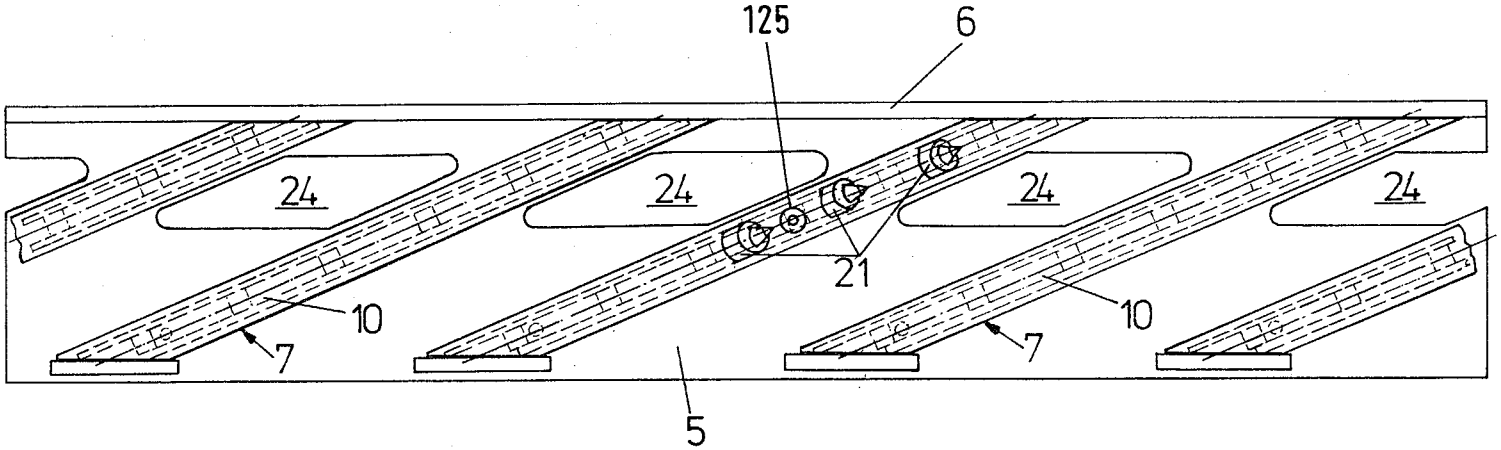
FIG. 4 is a smaller-scale developed view of the tubular wall of the second section of the cutter and of the supports for the additional bits.

The tubular wall 5 of the section B has outlets 24 in the form of circular or otherwise configurated openings (FIG. 4 shows that the outlets 24 are slots) which permit comminuted material of the core to leave the interior of the tubular wall 5 and to enter the spaces between the external surface of the wall 5 and the arcuate supports 7.

Cooling channels 25 between the webs 10 and the partitions 11 of the supports 7 receive a liquid (preferably water) which is sprayed onto the adjacent material of the mine face while the additional bits 21 remove such material. The spraying is effected by nozzles 125 (one shown in FIG. 4) which are mounted in the webs 10. The channels 25 receive liquid by way of a passage including the interior of the casting 1, the space between the member 3 and the rear side of the bottom wall 12, ports 26 in the member 3, an annular space 27 between the tubular wall 5 and the cylindrical partition 14, and pipes 28 which communicate with the space 27 and with the channels 25 and are mounted in the respective supports 7. Sealable apertures 29 in the member 4 afford access to the interior of the space 27 for the purpose of cleaning when plugs (not shown) which normally seal the apertures 29 are removed.

It will be noted that FIGS. 1–4 show only some of the bits 20, 21 and 22.

The operation of the cutter is as follows:

The casting 1 is rotated by the prime mover of the mining machine and is caused to move forwardly toward the mine face in an underground excavation. The bits 20 of the first set are caused to penetrate into and remove material from the mine face to form a ring-shaped groove which surrounds a solid cylindrical core (thus, the improved cutter can be said to constitute a core borer). The bits 22 of the second set do not participate in initial gouging out of material from the mine face, i.e., the initial removal of material takes place without the assistance from those bits (22) which are nearer to the common axis X-X of the casting 1 and of the cutter including the sections A, B, the supports 7 and the bits 20, 22 and 21. Since the distance between the axis X-X and the additional bits 21 is not much greater than the distance between the axis X-X and the bits 20 of the first set, the bits 20 are not likely to jam and to cause the cutter to rotate about the axis of a jammed bit 20. Thus, the improved cutter does not exhibit the aforediscussed drawback of conventional cutters wherein the bits which are nearest to the axis of the cutter participate in initial removal of material from the mine face. In other words, the peripheral speed of the bits 20 which are first to penetrate into the mine face is substantial (and the torque is relatively small) because such bits 20 are remote from the axis X-X. This further reduces the likelihood of pronounced wear upon the bits 20 and/or their holders during the initial penetration of the cutter because the specific stresses upon the bits 20 are relatively low. The inner diameter of the annulus of bits 20 is relatively large, i.e., much larger than the diameters of paths along which the foremost bits of conventional conical or frustoconical cutters travel when such cutters are set in rotary motion. Moreover, and since the diameter of the ring-shaped carrier 15 is preferably large, this carrier can support a large number of bits 20 so that the specific stresses upon individual bits 20 are surprisingly low. The orientation of the bits 20 is also more satisfactory than in heretofore known cutters. Thus, the axes of the centrally located bits 20 can be substantially parallel or nearly parallel to the axis X-X to achieve an optimum material removing action. Otherwise stated, the bits 20 which are to remove material during the forward movement of the cutter are located at the foremost part of the cutter and their orientation is such that they can apply cutting or material removing forces at an optimum angle. The bits 22 of the second set are not active during the initial penetration of the bits 20 into the exposed side of a mine face; therefore, the bits 22 cannot jam and cannot cause the cutter to rotate about an axis other than the axis X-X. Such jamming in conventional cutters is attributable to the fact that the bits which are first to come in contact with the material of the mine face are nearest to the axis of the cutter. It has been found that the exclusion of bits 22 from participation in the initial stage of removal of material greatly reduces noise as well as vibrations and other stray movements of the cutter.

Figure 3:
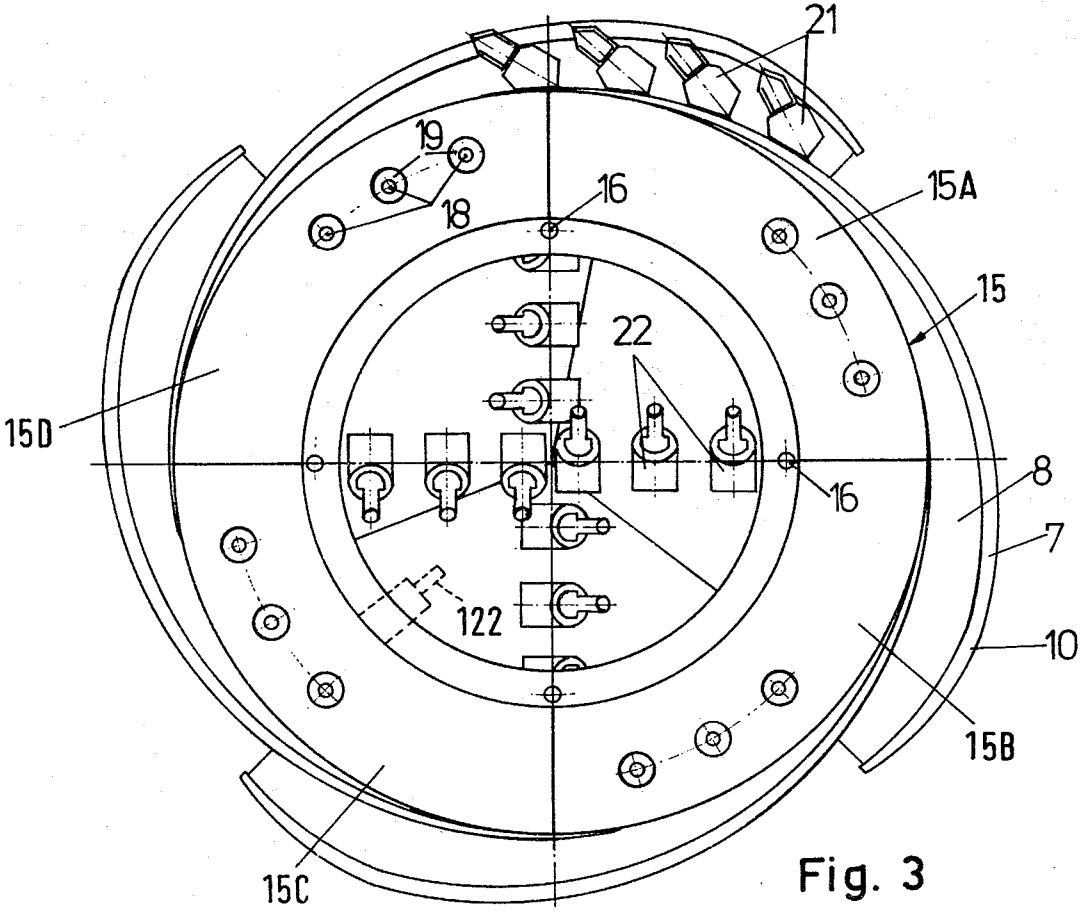
FIG. 3 is a smaller-scale plane view of the cutter as seen in the direction of arrow III in FIG. 2.

The bits 22 of the second set can be mounted on the bottom wall 12 (as actually shown in the drawing) or at the innermost portion of the carrier 15 to remove material from the core when the cutter is caused to move sideways. One such bit is indicated in FIG. 3 by broken lines, as at 122. When the bits 22 are replaced by the bits 122, the bits 122 remove material from the core while the bits 21 remove material from the external surface of the annular groove which is formed by the bits 20 of the first set. In such instances, the innermost portion of the carrier 15 which supports the bits 122 can be said to form part of the section B.

The arrangement which is shown in the drawing is preferred because the bits 22 which are mounted on the bottom wall 12 insure predictable comminution of the core during the forward movement of the cutter, i.e., while the bits 20 of the first set form the aforementioned annular groove. The fact that the second set of bits (22) includes or may include bits which are close to the axis X-X does not adversely influence the operation of the cutter because the comminution of a core which is separated from the major part of the mine face by an annular groove (obtained as a result of gouging out ore by the bits 20 of the first set) requires the application of forces which are only a small fraction of forces developing when the bits at or close to the axis of a conventional conical or frustoconical cutter remove material during the initial penetration of the cutter into a mine face or the like. Therefore, the wear upon the bits 22 of the second set is not pronounced; in fact, the useful life of such bits is a multiple of the useful life of the bits performing an analogous function in conventional cutters. Moreover, the improved cutter is highly unlikely to rotate about an axis other than the axis X-X (even if one of the bits 22 exhibits a tendency to jam) because the first section A penetrates into the annular groove which is formed by the bits 20 and is held against lateral movement by the surface which surrounds such annular groove. In other words, as the section A penetrates into the annular groove and the rear end of the core is comminuted by the bits 22, such bits are unable to change the axis of rotation of the cutter because the section A cannot move sideways until and unless the casting 1 is caused to move sideways.

The bottom wall 12 is preferably a wide cone of small or negligible height to insure that the bits 22 of the second set engage and comminute a fully developed cylindrical or nearly cylindrical core. The material which is removed from the core is permitted to leave the interior of the tubular wall 5 via the outlets 24 which are preferably closely adjacent to the front side of the bottom wall 12. The comminuted material of the core which leaves the section B via the outlets 24 descends by gravity or is readily removable in any suitable way. In fact, the rotating arcuate supports 7 promote the expulsion of comminuted material from the spaces between these supports 7 at the outer side of the tubular wall 5.

The improved cutter is susceptible of many modifications without departing from the spirit of the invention. For example, the number and orientation of the bits 20, 21 and/or 22 can be varied within a wide range. Furthermore, the diameter of the section A can be altered, i.e., increased if the material of the mine face is relatively soft and reduced if the material is hard. Still further, the carrier 15 can be assembled of several arcuate components each of which is separably secured to the base 6 by one or more screws 115 or analogous fastening means so that destruction of or damage to the bits 20 on one of the components of the carrier 15 need not entail complete dismantling or separation of the entire carrier 15. FIG. 3 shows that the carrier 15 may consist of four components 15A, 15B, 15C, 15D each of which may extend along an arc of 90 degrees. The provision of a composite carrier which consists of two or more separable arcuate components is especially desirable when the cutter is used to remove material in underground excavations.

The improved cutter can be used for removal of rock, coal or other materials in surface mining or underground mining.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A rotary cutter for gouging out ore from seams, particularly in underground excavations, comprising an annular section having an outer periphery; a second section coaxially surrounded by and located rearwardly of said annular section; a first set of material removing bits provided on said annular section and operative for removing material from the seam while the cutter moves forwardly with said annular section located ahead of said second section whereby the non-removed material within said annular section forms a core which extends toward said second section; a second set of bits provided on said second section rearwardly offset from said bits of said first set and operative for comminuting the material of the core during the forward movement of the cutter; and a third set of material removing bits mounted on and extending outwardly of said outer periphery of said annular section and operative for removing additional material from the seam while the cutter moves transversely to its axis along the face of the seam while said bits of said second set are out of contact with the material of the seam.

2. The cutter of claim 1, wherein said second set includes bits remote from the axis of said annular section.

3. The cutter of claim 1, wherein said second section includes a bottom wall remote from said first section and the bits of said second set are mounted on said bottom wall.

4. The cutter of claim 3, wherein said bottom wall has a substantially conical external surface facing toward said annular section and the bits of said second set are mounted on and extend forwardly of said conical surface.

5. The cutter of claim 4, wherein the height of said conical surface, as considered in the axial direction of said annular section, is a small fraction of the inner diameter of said annular section.

6. The cutter of claim 1, wherein said second section has outlets for comminuted material of the core.

7. The cutter of claim 6, wherein said second section includes a bottom wall remote from said annular section and said outlets are adjacent to said bottom wall.

8. The cutter of claim 7, wherein said second section further includes a tubular portion and said outlets are provided in said tubular portion.

9. The cutter of claim 8, further comprising arcuate supports located outwardly of said tubular portion and sloping outwardly and rearwardly, as considered in the direction of rotation of said cutter, said bits of said third set being provided on said supports and said outlets being arranged to discharge the comminuted material of the core between said supports at the exterior of said tubular portion.

10. The cutter of claim 1, wherein said annular section includes a base and a carrier for the bits of said first set, said carrier comprising a plurality of arcuate components and further comprising means for separably fastening said components to said base.

11. The cutter of claim 1, wherein said sections are welded to each other and at least some bits of each of said first and second sets have different orientations.

* * * * *

UNITED STATES PATENT AND TRADEMARK OFFICE

CERTIFICATE OF CORRECTION

PATENT NO. : 4,244,626

DATED : January 13, 1981

INVENTOR(S) : Klaus KONIECZNY, Erich SCHMITT and Adolf BUHLES

It is certified that error appears in the above-identified patent and that said Letters Patent are hereby corrected as shown below:

Claim 1 of the patent should read as follows:

--1. A rotary cutter for gouging out ore from seams, particularly in underground excavations, comprising an annular section having an outer periphery of a considerable axial length substantially corresponding to the maximum depth of penetration of the rotary cutter into the respective seam; a second section coaxially surrounded by and located rearwardly of said annular section; means for removing material from a region of the seam located frontwardly of said annular section, including a first set of material removing bits provided on and extending substantially frontwardly of said annular section and operative for forming a groove in the seam, while the cutter moves forwardly with said annular section located ahead of said second section, which separates a core of non-removed material situated within said annular section and extending toward said second section from the remainder of the seam; means for comminuting the material of the core, including a second set of bits provided on said second section rearwardly offset from said bits of said first set;

UNITED STATES PATENT AND TRADEMARK OFFICE

CERTIFICATE OF CORRECTION

PATENT NO. : 4,244,626

DATED : January 13, 1981

INVENTOR(S) : Klaus KONIECZNY, Erich SCHMITT and Adolf BUHLES

It is certified that error appears in the above-identified patent and that said Letters Patent are hereby corrected as shown below:

Claim 1 of the patent (continued):

and means for removing additional material from the seam externally of said annular portion, including a third set of material removing bits mounted on and distributed over the length of said outer periphery of said annular section and extending outwardly from the latter, said bits of said third set being operative for removing the additional material from the seam as the cutter moves transversely to its axis along the face of the seam while said bits of said second set are out of contact with the material of the seam.--

Signed and Sealed this

Sixth Day of October 1981

[SEAL]

*Attest:*

GERALD J. MOSSINGHOFF

*Attesting Officer*

*Commissioner of Patents and Trademarks*